United States Patent [19]

Odoerfer

[11] 4,193,240

[45] Mar. 18, 1980

[54] EXTERIOR WALL COMPOSITION

[76] Inventor: Hans F. Odoerfer, 12801 Monk Blvd., Pierrefonds, Quebec, Canada

[21] Appl. No.: 932,670

[22] Filed: Aug. 10, 1978

[51] Int. Cl.[2] ..... E04B 2/00

[52] U.S. Cl. ..... 52/344; 52/403; 52/743

[58] Field of Search ..... 52/344, 741, 743, 403

[56] References Cited

U.S. PATENT DOCUMENTS

| | | | |
|---|---|---|---|
| 3,320,707 | 5/1967 | Berg | 52/403 X |
| 3,466,825 | 9/1969 | Guddal | 52/344 |
| 4,047,346 | 9/1977 | Alderman | 52/743 |
| 4,114,333 | 9/1978 | Jones et al. | 52/741 |

OTHER PUBLICATIONS

Gold Bond, "Gypsum Wall Board Construction," Feb. 1967.

*Primary Examiner*—J. Karl Bell

*Attorney, Agent, or Firm*—Guy J. Houle; Alan Swabey; Robert Mitchell

[57] ABSTRACT

An exterior wall composition for building structures and a method of making same. The wall structure comprises a lattice framework of rigid load bearing steel studs which are secured together. The studs are provided with inner and outer attachment flanges and an inner wall membrane is secured to the inner attachment flanges to define an inner wall surface. A layer of insulating material is sprayed and adhered on an inner face of the inner wall membrane between the studs. A reinforcing material layer having interstices is secured at least to some of the outer attachment flanges of the studs. A layer of concrete material is sprayed on the insulating material and extends outwardly of the reinforcing material layer whereby the studs are embedded between an outer wall surface of the concrete material and the inner wall membrane.

10 Claims, 3 Drawing Figures

EXTERIOR WALL COMPOSITION

BACKGROUND OF THE INVENTION (a) Field of the Invention

The present invention relates to an exterior wall composition for building structures and a method of making same and more particularly a wall composition wherein concrete is sprayed on an inner wall membrane which is secured to a lattice framework of load bearing steel studs.

(b) Description of Prior Art

Various types of wall structures are known utilizing concrete. Some of these walls structures are formed by precast concrete slabs interconnected together and an insulating layer is then adhered to an inner face of the slabs with a finish board material secured thereover. The concrete slabs are usually held together by steel inserts provided at strategic locations or else the slabs are formed with joints which intermesh with joints of adjoining slabs to interlock. Open joints are then grouted and a seal is formed by applying a sealing compound. A disadvantage of such methods is that it is required to make the concrete slabs at a remote factory and transport these on site. Also, large machinery is required to erect the concrete component parts of the structure. A further disadvantage is that the inside finishing of such structures is complex requiring the securement of struts to set concrete. Furthermore, molds are required to make the concrete slabs.

Other concrete wall compositions are known where concrete is poured within a form which is erected on site. A disadvantage of this type of wall construction is that form work is required which is an expensive and time consuming operation. Further, an inner and/or outer finished wall must be constructed after the forms are removed once the concrete has set.

SUMMARY OF INVENTION

It is a feature of the present invention to provide an exterior wall composition for building structures and a method of making same which is an improvement over existing prior art concrete wall structures and methods of making same.

According to the above feature, from a broad aspect, the present invention provides an exterior wall composition for building structures, which composition comprises a lattice framework of rigid wall structural members. At least some of the wall structural members have inner and outer attachment means. An inner wall membrane is secured to at least some of the inner attachment means of the wall structure members to define an inner wall surface. A layer of insulating material is sprayed and adhered on an inward face of the inner wall membrane and between the wall structural members. A reinforcing material layer, having interstices, is secured to at least some of the outer attachment means. A layer of concrete material is sprayed on the insulating material and extends outwardly of the reinforcing material layer whereby the wall structural members are embedded between an outer wall surface of the concrete material and the inner wall membrane.

According to a further broad aspect of the present invention there is provided a method of making an exterior wall for building structures. The method comprises the steps of forming a lattice framework of rigid wall structural members and securing an inner wall membrane to an inner side of the structural members. A layer of insulating material is sprayed on an inward face of the inner wall membrane to adhere thereto. A reinforcing material layer, having interstices, is secured to an outer side of the structural members. A layer of concrete material is sprayed on the insulating material through the interstices with the layer of concrete extending outwardly of the reinforcing material layer to form an outer wall surface.

BRIEF DESCRIPTION OF DRAWINGS

A preferred embodiment of the present invention will now be described with reference to the accompanying drawings which are examples thereof and wherein.

DESCRIPTION OF PREFERRED EMBODIMENTS

Figure 1:
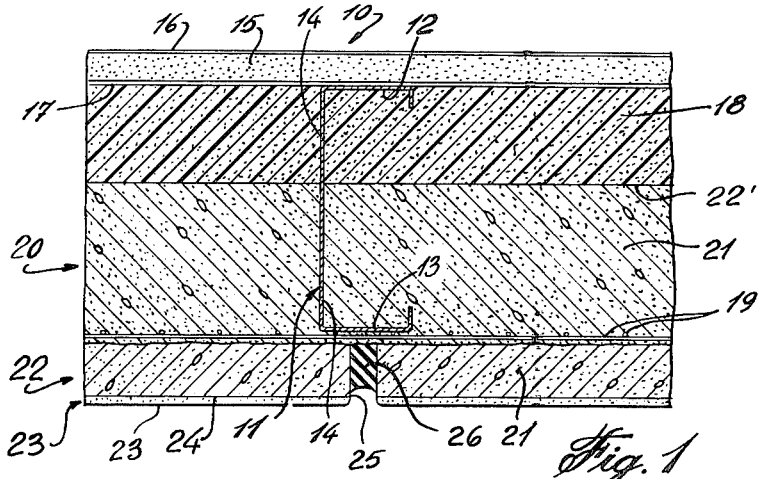
FIG. 1 is a cross-section view of the exterior wall composition.

Referring now to the drawings and more particularly to FIG. 1, there is shown generally at 10 the exterior wall composition of the present invention. The wall composition comprises a lattice framework constructed from a plurality of rigid wall structural members 11, herein constituted by load bearing galvanized steel studs of generally U-shaped configuration. The studs 11 are spaced vertically along a wall every sixteen or twenty-four inches, as is customary in wooden frame building structures, whereby to receive joints of building material every four feet and to provide a securement means every sixteen or twenty-four inches. The load bearing steel studs 11 each define, in cross-section, an inner flange 12 and an outer flange 13 formed integral and interconnected by a transverse web 14. The inner and outer flanges 12 and 13 respectively, constitute attachment means, as will be described later. Although the studs are herein shown as being of U-shaped cross-section, other cross-sections are possible to provide suitable attachment means and interconnection among themselves. Also, the interconnection of the studs in the lattice framework may be done by welding, bolting or other suitable fastening means well known in the art.

Figure 2:
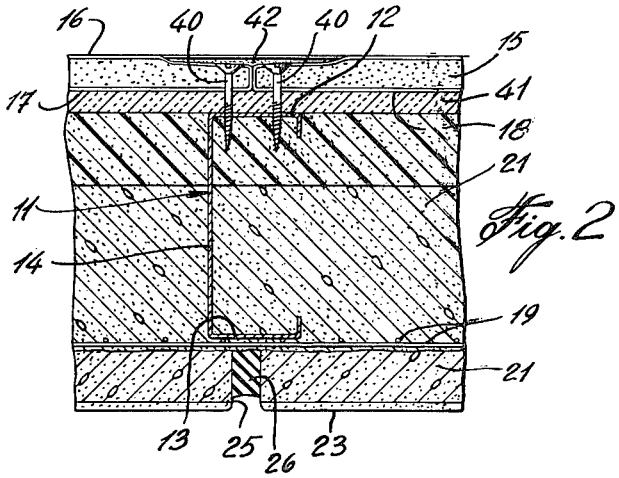
FIG. 2 is a cross-section view of a modification of the wall composition of FIG. 1.

An inner wall membrane 15, herein constituted by gyproc type sheeting, or other suitable material, is secured to the inner flange 12 of the studs 11. The inner wall membrane 15 has an outer finished surface 16 and an inner surface 17. The membrane 15 is secured to the flange 12 by suitable means, such as self-drilling and tapping screws 40 as shown in FIG. 2.

A layer of insulating material 18 is sprayed and adhered on the inner surface 17 of the membrane 15. The insulating material may be urethane insulation or other type insulation which can be sprayed. Alternatively, although not preferable, the insulating layer 18 may be of rigid sheet-like form and cut and attached to the inner surface 17 of the membrane 15. As shown, the insulating material extends between adjacent studs 11 in the lattice framework, where a solid wall is required.

A reinforcing material layer, herein a galvanized wire mesh 19 having interstices (openings) therein is secured over the solid wall area and attached to the outer flange 13 of the studs 11 by suitable fastening or attachment means (not shown). A first layer 20 of concrete (gunite) material 21 is sprayed onto the back face 22 of the insulating material 18 through the interstices in the galvanized wire mesh 19 and extends just beyond the wire mesh 19. Thus, the outer skin of the first layer 20 is reinforced by the galvanized wire mesh 19 to provide a reinforced outer surface to substantially prevent cracking, particularly in the area of the studs 11. After the first layer 20 is cured, a second layer 22 of concrete (gunite) material 21 is sprayed over the first layer 20. The second layer 22 of the concrete 21 includes a suitable bonding additive such as that identified by the registered trademark "Sika Top" of the Sika Company. Further, the concrete material 21 is preferably of a compressive strength of from about 3,000 p.s.i. to about 10,000 p.s.i. An outer layer 23 of stucco-type finish or painting is added to the outer surface 24 of the second layer 21 to create a desired exterior finish for the building. Further, expansion joints 25 are made in the concrete to conceal and control cracking of large concrete spans. A suitable sealing material 26 is inserted in the expansion joints 25. Preferably these expansion joints are made in alignment with some of the stud members.

As can be seen in FIG. 1 the studs 11 are embedded between the outer wall surface layer 23 or 22 and the inner wall membrane 15.

Referring now to FIG. 2, there is shown a modification of the embodiment of FIG. 1 and wherein an insulating thermal barrier membrane 41 is secured to the inner surface 17 of the membrane 15 or to the studs 11 under the membrane 15. Such a thermal barrier 41 may be provided depending on the climatic condition where the building structure is located. Also, as shown in FIG. 2, the inner flange 12 provides the attachment means for the self-drilling screws 40 which secure the inner wall membrane 15 thereto. Also, as shown the joint of the gyproc boards 15 are taped with perforated tape and jointing compound 42 is applied to conceal the joint and to form a smooth wall surface which can then be finished with either paint, wallpaper, ceramic tiles, wood panelling or whatever material is desired.

The method of making this exterior wall composition 10 does not require expert skills, uses known material and permits quick erection. To erect a building structure the floor slab is firstly poured with necessary services included therein. The exterior wall composition 10 is essentially a solid insulated concrete-steel panel assembled on site. Firstly, the basic lattice framework of load bearing steel studs 11 is shipped to the site precut to the proper lengths and assembled on site by suitable means such as welding. The steel stud lattice framework is attached to the base slab (not shown) by means of low velocity steel studs driven into the concrete with gun powder. After the lattice framework has been assembled with door, window openings, etc. the inner wall membrane 15 is secured to the inner side of the studs 11 over the area where the solid wall is required. The insulating material 18 is then sprayed over the inner surface 17 of the membrane 15 to a desired thickness depending on the insulating property required. Of course, the width of the studs 11 depends on the thickness of the wall required for the particular building structure.

The next step in the process is to secure the galvanized wire mesh 19 to the outer flange 13 of some of the studs whereby to hold the wire mesh sheet in place over the area where a solid wall is required. The first layer 20 of concrete (gunite) is applied to the desired thickness, in this particular example 2¼ inch, and is sprayed through the interstices of the wire mesh and against the backface 22 of the insulating material 18. After a curing and setting time of from about 12 to 24 hours, a second layer 22 of concrete, herein approximately ¾ inch in thickness, is sprayed and wood-float finished onto the first layer 20. The second layer of concrete contains a chemical additive to assure a good bonding and to eliminate cracking in the final surface. Of course, under ideal climatic conditions and with suitable concrete aggregates it is possible to utilize only one concrete layer 21. An outer stucco-finish 23 may then be applied to the second finish, if desired. This outer coating 23 may also be coloured or patterned, if desired.

Of course, all suitable conduits for wiring or plumbing is installed within the lattice framework before installing the inner wall membrane 15. Additionally, the insulating thermal barrier 41 may be applied to the inner surface 17 of the membrane 15 prior to the step of spraying the urethane insulation 18, if desired.

Figure 3:
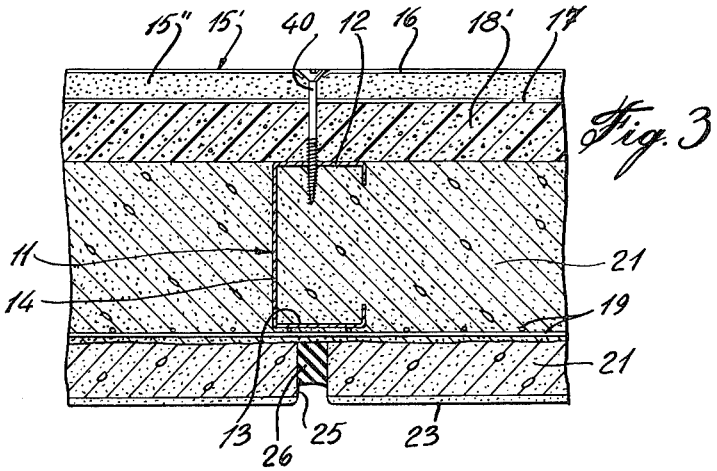
FIG. 3 is a cross-section view of a still further modification of the wall composition of FIG. 1.

Referring now to FIG. 3, there is shown a still further modification of the embodiment of FIG. 1 and wherein the inner wall membrane 15′ is constituted by an outer layer of gyproc 15″ and an inner layer 18′ of rigid insulating foam material. This membrane 15′ is secured by suitable fasteners to the inner flange 12 of the structural members 11 by suitable fasteners. As shown, with this type of membrane construction the structural members 11 may be of smaller width resulting in a material cost saving. Further, there is less labour content in the fabrication of the wall as the insulation layer 18′ is already part of the membrane. The concrete (gunite) material 21 is sprayed in the usual manner and extends beyond the wire mesh 19. The exterior surface of the concrete wall is finished as described above with reference to the other Figure.

It is within the ambit of the present invention to provide any obvious modifications of the examples of the preferred embodiment as illustrated by FIGS. 1 and 2 herein, provided such modifications fall within the scope of the broad claims appended hereto.

I claim:

1. An exterior wall composition for building structures, comprising a lattice framework of rigid wall structural members, at least some of said wall structural members having inner and outer attachment means, an inner wall membrane secured to at least some of said inner attachment means of said wall structural members to define an inner wall having a finished outer wall surface, a sprayed layer of insulating material on an inner face of said inner wall membrane between said structural members, a reinforcing material layer having interstices secured to at least some of said outer attachment means to define an outer reinforcing wall membrane, a first sprayed layer of concrete material sprayed on said insulating material and extending outwardly of said reinforcing material layer and cured thereon whereby said wall structural members are completely embedded between said first sprayed layer of concrete material and said inner wall membrane, and a second thinner layer of concrete material containing a bonding additive sprayed on an exterior surface of said first layer to constitute an outer wall surface.

2. An exterior wall composition as claimed in claim 1, wherein said concrete material has a compressive strength of from about 3,000 p.s.i. to about 10,000 p.s.i.

3. An exterior wall composition as claimed in claim 1, wherein said rigid structural members are load bearing galvanized steel studs secured together to form said lattice framework.

4. An exterior wall composition as claimed in claim 3, wherein said studs each have an inner and outer flange interconnected by a transverse web and formed integral therewith, said inner and outer attachment means being constituted by said inner and outer flange, respectively.

5. An exterior wall composition as claimed in claim 4, wherein said inner wall membrane is formed from sheet material which is secured to said inner flange of at least some of said studs by self-drilling and tapping screws.

6. An exterior wall composition as claimed in claim 1, wherein said insulating material is a urethane material forming a vapour barrier, said reinforcing material being galvanized wire mesh attached to said outer flange of at least some of said studs.

7. An exterior wall composition as claimed in claim 1, wherein there is further provided an insulating thermal barrier layer between said inward face of said inner wall membrane and said layer of insulating material, a plurality of expansion joints in said outer wall surface of said concrete material, said outer wall surface further having a fine stucco concrete finishing layer.

8. A method of making an exterior wall for building structures, said method comprising the steps of:

(i) forming a lattice framework of rigid wall structural members with at least some of said members having inner and outer attachmeans means, (ii) securing an inner wall membrane to said inner attachment means of said structural members to define an inner wall having a finished outer wall surface, (iii) spraying a layer of insulating foam material on an inward face of said inner wall membrane between said structural members, (iv) securing a reinforcing material layer having interstices to said outer attachment means to define an outer reinforcing wall membrane, (v) spraying a first layer of concrete material on said insulating material through said interstices with said layer of concrete extending outwardly of said reinforcing material layer, (vi) curing said first layer of concrete material for a period of at least about 12 to 24 hours, and (vii) spraying a second thinner layer of said concrete material having a bonding additive onto said first layer to form an outer wall surface, said concrete material having a compressive strength of from about 3,000 p.s.i. to about 10,000 p.s.i.

9. A method as claimed in claim 8 wherein said step (i) comprises welding a plurality of load bearing galvanized steel studs together, said step (ii) comprises securing a plurality of wall boards to at least some of said studs; and wherein a plurality of expansion joints are made in said outer wall surface, and applying a finish stucco finish layer on said outer wall surface.

10. A method as claimed in claim 8 wherein after step (ii) and before step (iii) there is provided the step of securing an insulating thermal barrier layer on an inward face of said inner wall membrane, said layer of insulating material being sprayed onto said thermal barrier layer.

* * * * *